US006447667B1

(12) United States Patent
Bates et al.

(10) Patent No.: US 6,447,667 B1
(45) Date of Patent: Sep. 10, 2002

(54) THERMAL SHOCK PROTECTION FOR ELECTROLYSIS CELLS

(75) Inventors: Calvin Bates, Monroeville; Patricia A. Stewart, Pittsburgh; Larry F. Wieserman, Apollo, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 64 days.

(21) Appl. No.: 09/765,185

(22) Filed: Jan. 18, 2001

(51) Int. Cl.[7] ..... C25C 3/08

(52) U.S. Cl. ..... 205/384; 205/385; 205/386; 205/388; 205/390; 205/399; 204/243.1; 204/247.5; 204/280; 204/291; 204/292; 204/290.01; 204/290.15

(58) Field of Search ..... 205/390, 364, 205/367, 369, 384, 380, 388, 399, 385, 386; 427/77; 204/243.1, 247.5, 280, 291, 292, 290.01, 290.15

(56) References Cited

U.S. PATENT DOCUMENTS

| | | | | |
|---|---|---|---|---|
| 4,158,568 A | 6/1979 | LaBar | ..... | 106/64 |
| 4,428,847 A | 1/1984 | Boxall et al. | ..... | 502/101 |
| 5,341,562 A | 8/1994 | Furuya et al. | ..... | 29/825 |
| 5,865,980 A | 2/1999 | Ray et al. | ..... | 205/367 |

*Primary Examiner*—Bruce F. Bell
(74) *Attorney, Agent, or Firm*—Glenn E. Klepac

(57) ABSTRACT

A cermet anode of an electrolytic cell is protected from thermal shock during cell start-up by coating an outer surface portion of the anode with a coating composition comprising carbon or aluminum or a mixture thereof. A particularly preferred coating composition includes an aluminum underlayer adjacent the outer surface portion of the anode, and a carbon overlayer overlying the underlayer. A support structure assembly supporting the cermet anode includes a high alumina ceramic material. In a preferred embodiment, the high alumina ceramic material is protected from thermal shock and corrosion by the coating composition of the invention.

19 Claims, 5 Drawing Sheets

THERMAL SHOCK PROTECTION FOR ELECTROLYSIS CELLS

FIELD OF THE INVENTION

The present invention relates to production of a metal by electrolysis of a metal compound in a cell having a cermet anode. More specifically, the invention relates to protection of the cermet anode and its support structure assembly from thermal shock during cell start-up.

BACKGROUND OF THE INVENTION

A number of metals including aluminum, lead, magnesium, zinc, zirconium, titanium, and silicon can be produced by electrolytic processes. Each of these electrolytic processes employs an electrode in a highly corrosive environment.

One example of an electrolytic process for metal production is the well-known Hall-Heroult process producing aluminum in which alumina dissolved in a molten fluoride bath is electrolyzed at temperatures of about 960–1000° C. As generally practiced today, the process relies upon carbon as an anode to reduce alumina to molten aluminum. The carbon electrode is oxidized to form primarily $CO_2$, which is given off as a gas. Despite the common usage of carbon as an electrode material in practicing the process, there are a number of serious disadvantages to its use.

Because carbon is consumed in relatively large quantities in the process, approximately 420 to 550 kg carbon per ton of aluminum produced, the electrode must be constantly repositioned or replenished to maintain proper anode-cathode spacing to produce aluminum efficiently. If prebaked electrodes are used a relatively large facility is needed to produce sufficient electrodes to operate a smelter. In order to produce aluminum of sufficient purity to satisfy customer standards, the electrodes must be made of having relatively low metal content carbon, and availability and cost of raw materials to make the carbon are of increasing concern to aluminum producers.

Because of disadvantages inherent in use of carbon for electrodes, some cermet materials have been developed that can operate as electrodes with a reasonable degree of electrochemical efficiency and withstand the high temperatures and corrosive environment of the smelting cell. Cermet electrodes are inert non-consumable and dimensionally stable under cell operating conditions. Replacement of carbon anodes with inert anodes allows a highly productive cell design to be utilized, thereby reducing costs. Significant environmental benefits are achievable because inert electrodes produce essentially no $CO_2$ or fluorocarbon or hydrocarbon emissions. Some examples of inert anode compositions are found in U.S. Pat. Nos. 4,374,050; 4,374,761; 4,339,088; 4,455,211; 4,582,585; 4,584,172; 4,460,905; 5,279,715; 5,794,112; 5,865,980; and 6,126,799, all assigned to Alcoa Inc. These patents are incorporated by reference.

Although cermet electrodes are capable of producing aluminum having an acceptably low impurity content, they are susceptible to cracking during cell start-up when subjected to temperature differentials on the order of about 900–1000° C. In addition, ceramic components of the anode support structure assembly are also subject to damage from thermal shock during cell start-up and from corrosion during cell operation. Accordingly, there still remains a need for a means of protecting cermet electrodes and the anode support structure from thermal shock and corrosion.

A principal objective of the present invention is to provide a coating for protecting a cermet anode and its support structure assembly from thermal shock during cell start-up.

A related objective of the invention is to provide a coating for protecting the support structure assembly from corrosion during cell operation.

Additional objectives and advantages of our invention will be apparent to persons skilled in the art from the following detailed description of some preferred embodiments.

SUMMARY OF THE INVENTION

In accordance with the present invention there is provided an electrolytic cell for production of a metal by electrolytic reduction of a metal compound contained in a molten salt bath. Metals that may be produced electrolytically in accordance with the invention include aluminum, lead, magnesium, zinc, zirconium, and titanium.

A preferred embodiment of the invention relates to production of aluminum by electrolytic reduction of alumina dissolved in a molten bath containing aluminum fluoride and sodium fluoride. An electrolytic current is passed between a cermet anode and a cathode through the salt bath, producing aluminum at the cathode and oxygen at the anode.

The molten salt bath comprises aluminum fluoride and sodium fluoride, and may also contain calcium fluoride, magnesium fluoride, and/or lithium fluoride. The weight ratio of sodium fluoride to aluminum fluoride is preferably about 0.7 to 1.1. The bath ratio is preferably about 0.8 to 1.0 and more preferably about 0.96.

As used herein, the term "inert anode" refers to a substantially non-consumable anode having satisfactory resistance to corrosion and dimensional stability during the metal production process. At least part of the inert anode comprises a cermet material. As used herein, the term "cermet" refers to a material having a ceramic phase and a metal phase. Inert anodes of the present invention may be made entirely of a cermet material over a central metal core. When the cermet is provided as an outer coating its thickness is preferably about 0.1 to 50 mm, more preferably about 1 to 10 or 20 mm. The ceramic phase preferably makes up about 50–95 wt % of the cermet material, the metal phase about 5–50 wt %. More preferably, the ceramic phase comprises about 80–90 wt % of the cermet and the metal phase about 10–20 wt %.

The ceramic phase of the cermet can be composed of any suitable oxide material including one or more metal oxides selected from the group consisting of Ni, Fe, Zn, Co, Al, Cu, Ti, V, Cr, Zr, Nb, Ta, W, Mb, Hf, and any of the rare earth metal oxides and at least one additional oxide from the above list. A particularly preferred ceramic phase embodiment comprises iron, nickel, and zinc oxides.

The metal phase of the cermet material comprises a base metal, such as Cu and/or Ag replaced in whole or in part by, or mixed or alloyed with one or more metals selected from the group consisting of Co, Ni, Fe, Al, Sn, Nb, Ta, Cr, Mo, W, and the like. The metal phase also comprises a noble metal such as one or more metals selected from Ag, Pd, Pt, Au, Rh, Ru, Ir, and Os. A preferred metal phase comprises copper as the base metal with the addition of at least one noble metal selected from Ag, Pd, Pt, Au, and Rh.

The metal phase may be continuous or discontinuous. When the metal phase is continuous it forms an interconnected network or skeleton that increases electrical conductivity. When the metal phase is discontinuous, discrete particles of the metal are at least partially surrounded by the ceramic phase, which may increase corrosion resistance.

The types and amounts of base metal and noble metal contained in the metal phase are selected in order to reduce unwanted corrosion, dissolution, or reaction of the inert anodes, and to withstand the high temperatures to which the inert anodes are subjected during the electrolytic production process. For example, in the electrolytic production of aluminum, the production cell typically operates at a sustained smelting temperature above 800° C., usually about 900–980° C. Accordingly, the metal phase of inert anodes in such cells should have a melting point above 800° C., more preferably above 900° C., and optimally above about 1000° C.

The metal phase typically comprises about 50–99.99 wt % base metal and about 0.01 to 50 wt % noble metal. Preferably, the metal phase comprises about 70–99.95 wt % of the base metal and about 0.05–30 wt % of the noble metal. More preferably, the metal phase comprises about 90–99.9 wt % base metal and about 0.1–10 wt % noble metal. For every numerical range or limit set forth herein, all numbers within the range or limit including every fraction or decimal between its stated minimum and maximum are considered to be designated and disclosed by this description.

Inert anodes useful in practicing the present invention are made by reacting a reaction mixture with a gaseous atmosphere at an elevated temperature. The reaction mixture comprises particles of metals and metal oxides blended together. In addition to the ceramic and metal portions, the mixture may also include an organic polymeric binder, plasticizer, and/or dispersant. These components are added in an amount of about 0.1 to 10 parts by weight per 100 parts by weight of the ceramic and metal particles. Some suitable binders include polyvinyl alcohol, acrylic polymers, polyglycols, polystyrene, polyacrylates, and mixtures and copolymers thereof. Preferably, about 0.3 to 6 parts by weight of the binder or other components are added to 100 parts by weight of the ceramic and metal mixture.

The blended ceramic and metal powders are sent to a press where they are isostatically pressed, for example at 5,000 to 40,000 psi, into anode shapes. A pressure of about 20,000 psi is particularly suitable for many applications.

The pressed shapes may then be sintered in a controlled atmosphere furnace supplied with an argon-oxygen gas mixture, a nitrogen-oxygen gas mixture, or other suitable gas mixtures. Sintering temperatures of between about 1,000 and 1,400° C. are typically suitable. The furnace is typically operated at between about 1,350 and 1,385° C. for two to four hours. If a polymeric binder is used, the sintering process will burn out any of the binder from the anode shapes.

The gas supplied during sintering preferably contains about 5–3,000 ppm oxygen, more preferably about 5–700 ppm oxygen and most preferably about 10–350 ppm oxygen. Lesser concentrations of oxygen can result in a product having a larger metal phase than desired, and excessive oxygen can result in a product having too much of a ceramic phase. The remainder of the gaseous atmosphere preferably comprises a gas such as argon that is inert to the metal at the reaction temperature.

Sintering anode compositions in an atmosphere of controlled oxygen content typically lowers the porosity to acceptable levels and avoids the bleed out of the metal phase. The atmosphere may be predominantly argon, with controlled oxygen contents in the range of 17–350 ppm. The anodes may be sintered in a tube furnace at 1,350° C. for two hours. Anode compositions sintered under these conditions typically have less than 0.5% porosity when the compositions are sintered in argon containing between about 70 and 150 ppm oxygen.

The electrolytic cell of our invention includes a cermet electrode, a support structure assembly, and a chamber containing the molten salt bath. The cermet electrode is preferably an anode including a body having an outer surface portion. The support structure assembly includes a metal conductor electrically connected with the cermet anode. The support structure assembly may also include a part containing a high alumina ceramic material. As used herein, the term "high alumina ceramic material" refers to a ceramic material containing at least 80 wt % $Al_2O_3$, preferably at least 90 wt %, and more preferably about 95 wt %. The ceramic material may be a high temperature castable ceramic, a high temperature ceramic board, or a combination thereof.

The high alumina ceramic material comprises a refractory material, preferably a mixture of calcium aluminate cement and tabular alumina. Optionally, the refractory material may include about 0.5–5 wt % of zinc borosilicate frit. When desired, about 0.1 to 1 wt % boric acid may be added as corrosion retarder. Additional details of the high alumina ceramic material are found in La Bar U.S. Pat. No. 4,158,568, the disclosure of which is incorporated herein by reference.

A particularly preferred high alumina ceramic material contains a mixture of tabular alumina (−48 mesh Taylor series); calcium aluminate cement (sold by Alcoa World Chemicals under the trademark C-25); and boric acid. A suitable high alumina ceramic material sold by Permatech Inc. of Graham, N.C. under the trademark "Permatech Alpha". Contains about 95 wt % $Al_2O_3$; about 4.0 wt % CaO; about 1.0 wt % other ingredients. The material has a bulk density of 180 lb/ft$^3$ (2885 kg/m$^3$), 18–20% apparent porosity, and 3.5 specific gravity. Maximum use temperature is 2600° F. (1427° C.).

An alternative high alumina ceramic material is sold by Harbision-Walker Refractories Co. under trade name SHAC (special high alumina castable). The material's nominal composition is 94.8 wt % alumina, 4.9 wt % lime (CaO), 0.1 wt % MgO, 0.1 wt % alkalis, and trace silica.

In order to protect the cell from thermal shock during start-up, at least one of the outer surface portion of an anode and a portion of the support structure assembly is coated with a layer comprising carbon or aluminum or a mixture of carbon and aluminum A carbon layer is preferred. The carbon layer may have a thickness of about 0.1–10 mm. A particularly preferred carbon layer has a thickness of about 1–3 mm. The carbon layer is preferably applied by dipping or spraying.

A particularly preferred protective coating includes an underlayer comprising aluminum adjacent the outer surface portion of the anode, and a carbon overlayer coated over the underlayer. The aluminum underlayer may have a thickness of about 0.1–5 mm. A particularly preferred underlayer has a thickness of about 0.2–1 mm. The aluminum underlayer may be applied by a variety of coating methods including thermal spraying, electrocoating, electroless plating, physical vapor deposition, powder cementation, chemical vapor deposition, immersion, painting, and electrostatic spraying.

DETAILED DESCRIPTION OF THE PREFERRED EMBODIMENTS

Figure 1:
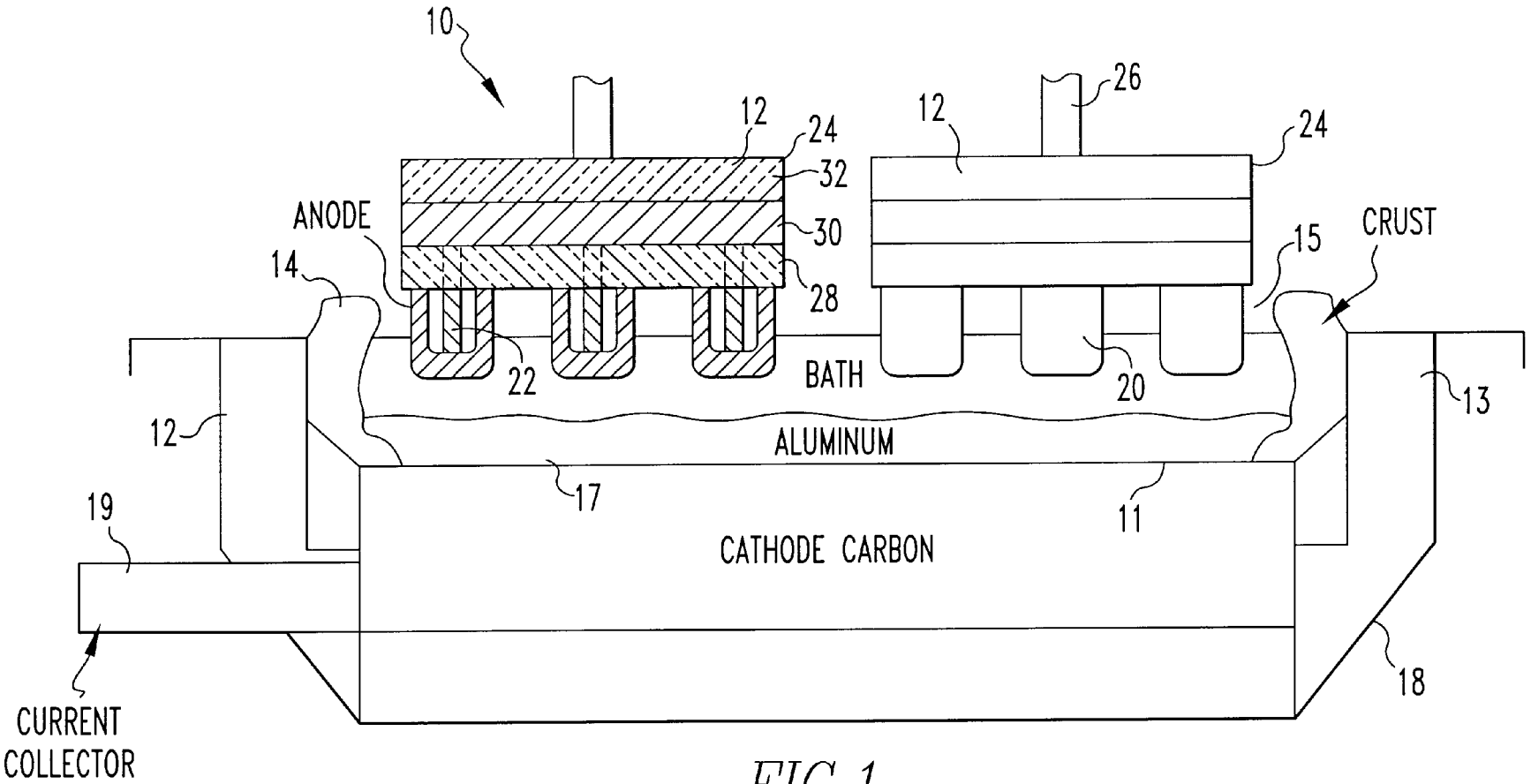
FIGS. 1 and 2 are schematic illustrations of an electrolytic cell of the present invention.
Figure 2:
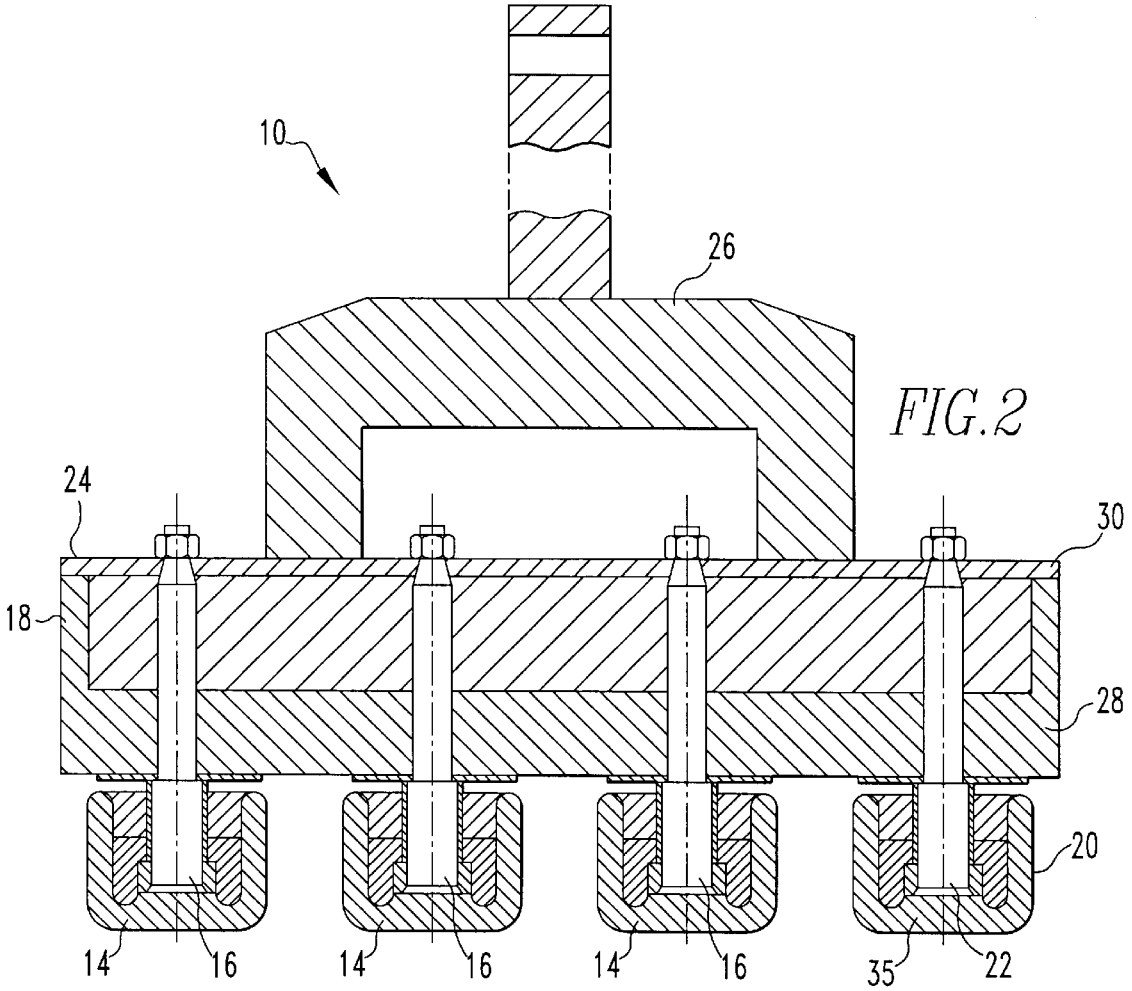

The insulating coating of our invention is suitable for use in an electrolytic cell 10 for aluminum production, as shown in FIGS. 1 and 2. The cell 10 includes a carbon cathode floor 11 and sidewalls 12, 13 extending upwardly from the floor 11. The sidewalls 12, 13 are both covered by a solid crust 14. The floor 11 and sidewalls 12, 13 define a chamber 15 above the pad 17. A steel shell 18 supports the floor 11 and sidewalls 12, 13. A metal collector bar 19 carries current from the carbon cathode floor 11.

The cell 10 includes several anodes 20 fastened by electrically conductive metal conductors 22 to an insulating lid 24. The lid 24 is supported by a support beam 26. The conductors 22, lid 24, and support beam 26 together make up a support structure assembly for the anodes 20.

The conductors 22 are made of any suitable material providing electrical conductivity to the anodes 20. The insulating lid 24 preferably includes one or more thermal insulating layers of any suitable composition. For example, a highly corrosion resistant insulating material is provided on a lower portion 28 of the lid 24 exposed to the chamber 15, while a material having high thermal insulation value is provided in the interior 29. An electrically conductive metal plate 30 provides a current path between the support beam 26 and the conductors 22, as shown in FIG. 2. If desired, the plate 30 may be covered by a thermally insulating and corrosion resistant material 32. Optionally, electrically conductive copper straps (not shown) may connect the support beam 26 and the conductors 22.

In a particularly preferred embodiment of the invention, inert anodes 20 are protected from thermal shock during start-up by a two layer coating composition. As shown schematically in FIG. 3, each anode 20 includes a cermet body 35 having an outer surface portion 36. The coating composition includes an inner layer 38 of aluminum adjacent the outer surface portion 36, and an outer layer 39 of carbon overlying the inner aluminum layer 38.

Figure 3:
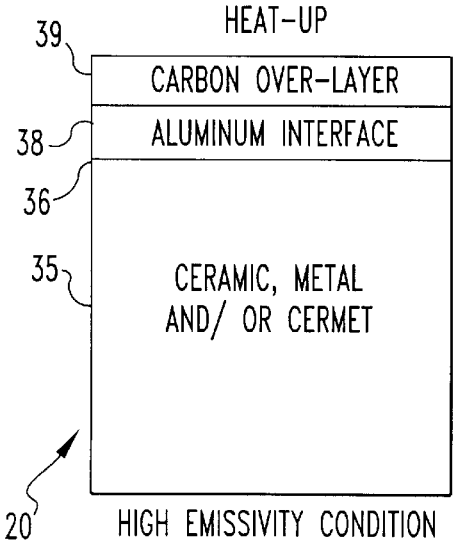
FIGS. 3 and 4 are schematic cross-sectioned views of an inert anode of the invention.

The coating composition shown in FIG. 3 is applied to the anode 20 in two steps. A layer 38 aluminum is applied to the outer surface portion 36, followed by an overlayer 39 of graphite over the aluminum layer 38. Both layers 38, 39 are preferably applied in the form of particles dispersed in a liquid vehicle. For example, the inner layer 38 is preferably applied as a coating of aluminum paint and the outer layer 39 preferably is applied as an aqueous dispersion of graphite particles. One suitable graphite dispersion is sold by Acheson Industries, Inc. of Port Horon, Mich. under the trademark DAG-137.

Figure 4:
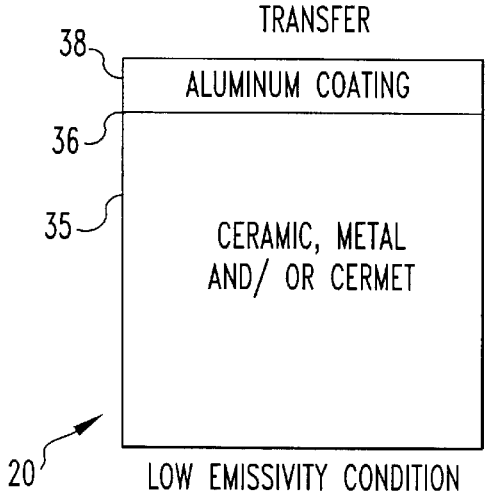

The anodes are heated in a furnace before being placed in an electrolytic cell in order to avoid thermal shock induced cracking when they contact a molten salt bath. Before heating, the anodes 20 are in a high emissivity condition as shown in FIG. 3. When the anodes 20 are removed from the furnace, the outer carbon layer 39 oxidizes away, leaving only the aluminum layer 38 adjacent the outer surface 36 as shown in FIG. 4. With only the aluminum layer 38 in place, the anodes 20 are in a low emissivity condition.

EXAMPLES

A differential thermal analysis (DTA) system was used to monitor temperatures of reference and coated samples. Both samples were a high alumina ceramic material made by combining tabular alumina, calcium aluminate cement, and a borosilicate frit. A particularly preferred high alumina ceramic material is sold under the trademark "Permatech Alpha" by Permatech, Inc. of Graham, N.C.

Four samples having dimensions of 1.0 in.×1.0 in.×7.0 in. were cast with thermocouples in the center of the sample. The green ceramic samples were fired at 1000° C. in a Fisher Isotemp furnace. After cooling to room temperature, one sample was painted with colloidal graphite dispersion and another sample was painted with aluminum paint. One uncoated sample served as a reference and the other as a blank for the experiments described below.

Figure 6:
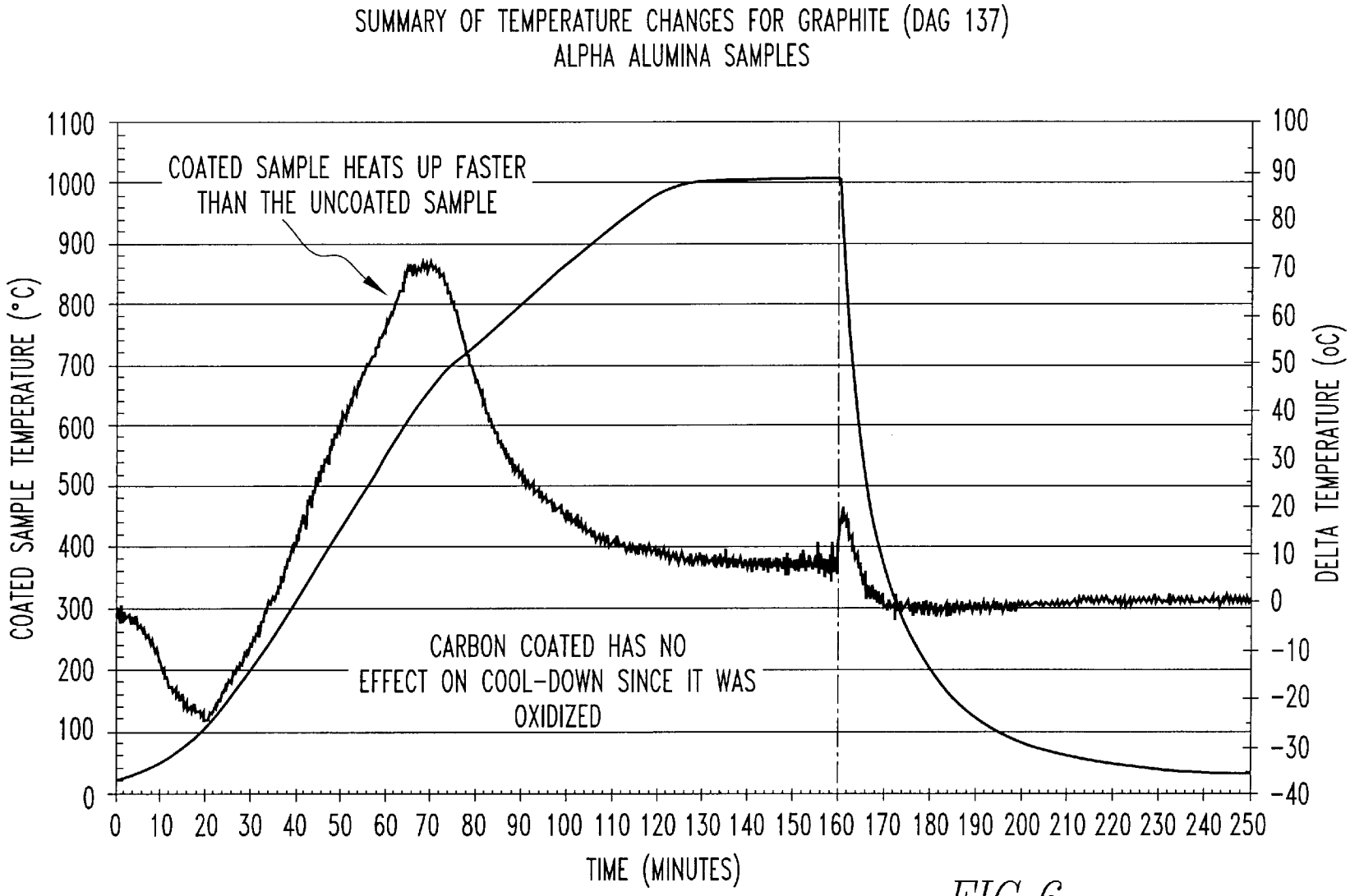
Figure 7:
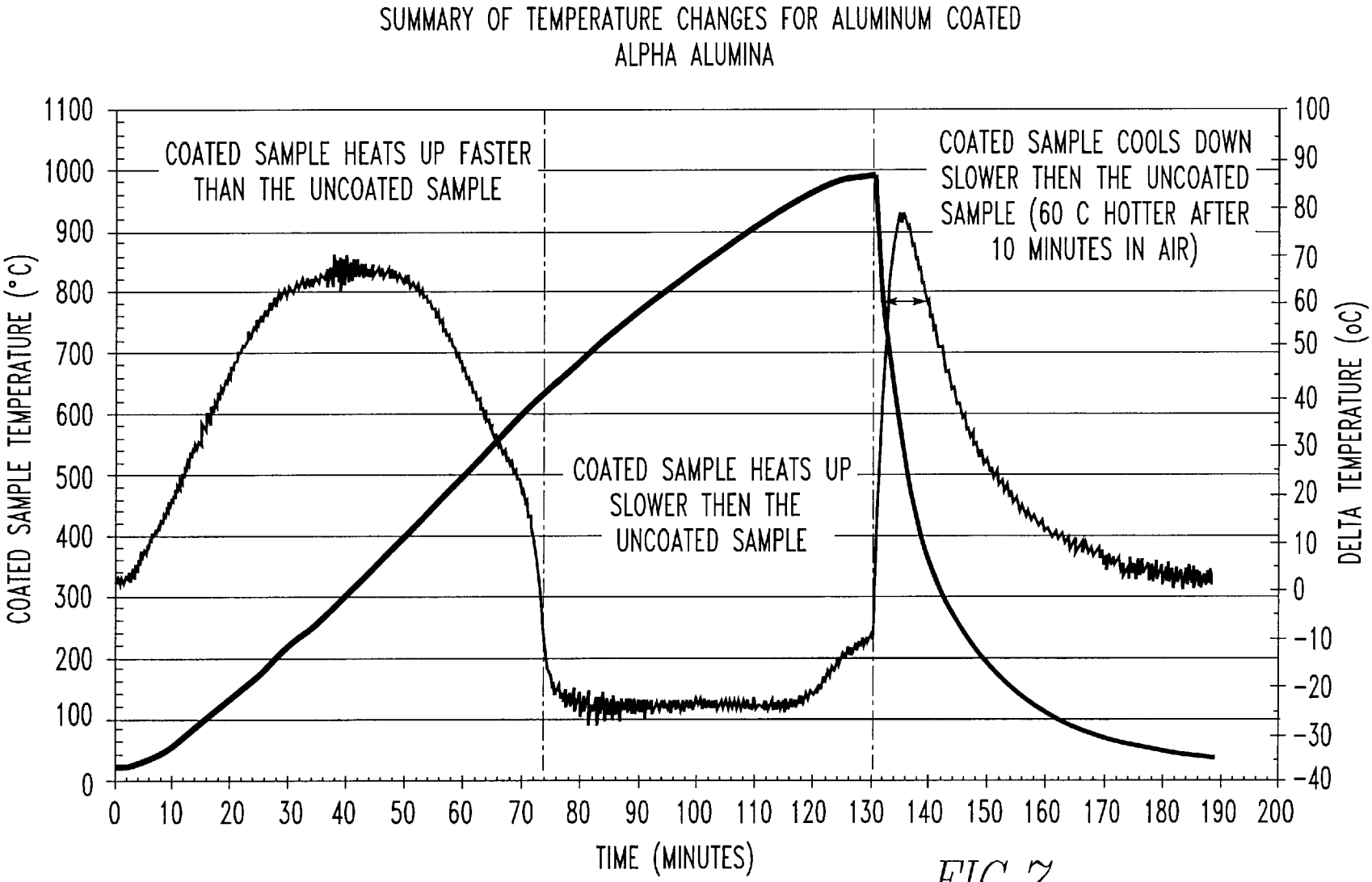

After drying in air, the coated sample and the uncoated sample were positioned at an equal distance from the walls of the furnace. A furnace ramp temperature of 10° C. per minute was initiated to heat the samples from room temperature to 1000° C. Upon reaching 1000° C., the sample and reference materials were allowed to equilibrate for a short time. The sample and reference materials were then quickly, simultaneously, and safely removed from the furnance. The materials were then allowed to cool in open air to room temperature before data collection stopped. Results are shown in FIGS. 5, 6, and 7.

1. Blank Sample

Figure 5:
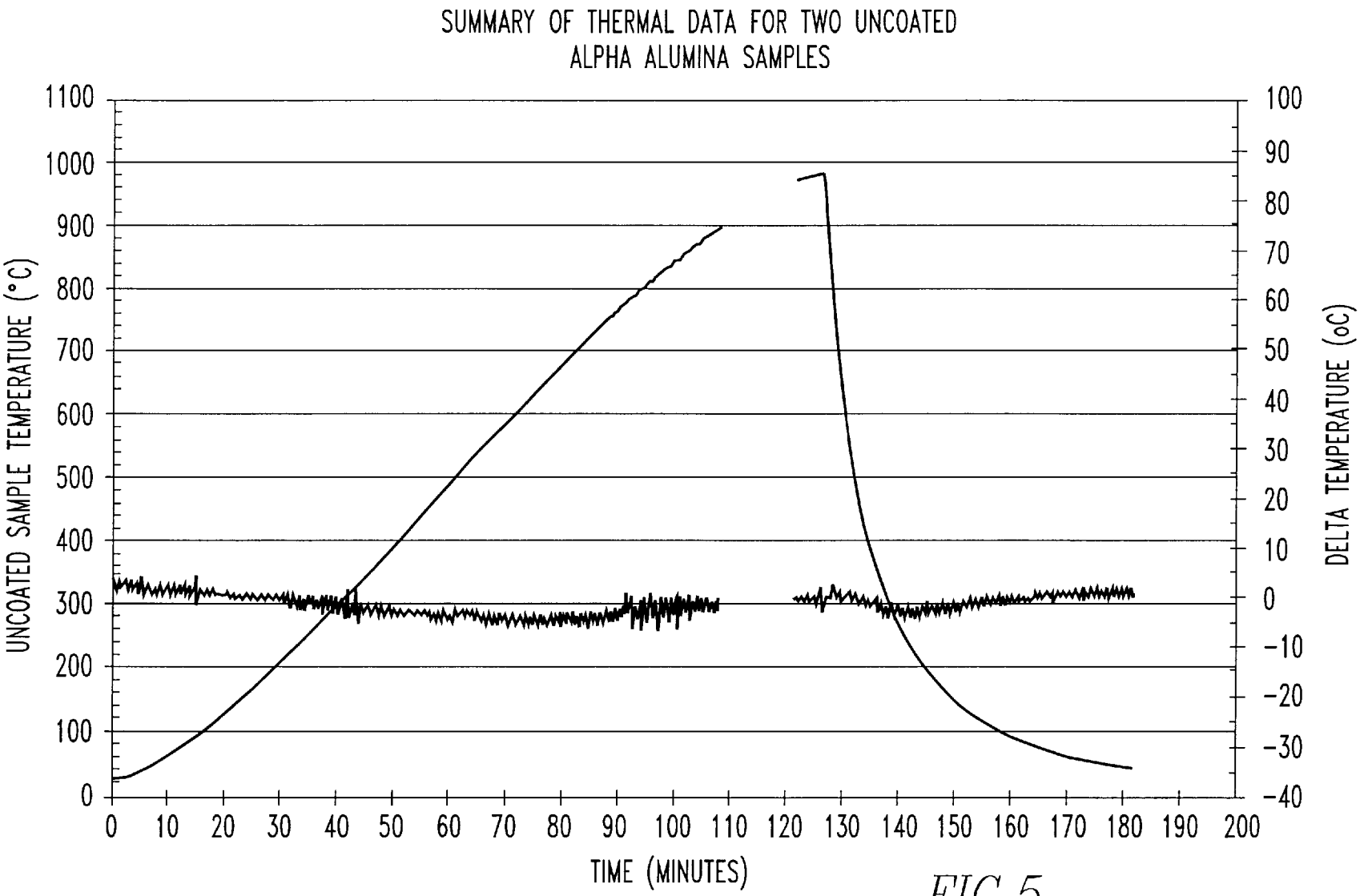
FIGS. 5–7 are differential thermal analysis (DTA) graphs of temperature as a function of time.

Temperature and DTA data for the 2 uncoated samples are shown in FIG. 5. Running the 2 uncoated samples confirmed that sample heat-up was uniform and that the DTA data acquisition system is sensitive. Heat transfer from the furnace to the ceramic samples was primarily by radiation heating. The heat up rate of the samples was relatively linear except for the first 30 minutes and the last 20 minutes. The DTA data for the uncoated blank was essentially a flat line, indicating little temperature difference between the sample and reference materials as they heated up and cooled down.

2. Graphite Coated Sample

Results of a DTA test on a sample coated with graphite are shown in FIG. 6. When the graphite coated sample was heated under a static air atmosphere it absorbed radiant heat more efficiently and also generated additional heat by oxidation or burning of the graphite. Both factors contributed to a higher temperature for the coated sample after 70 minutes than the reference sample. Immediately after removing the samples from the oven, there appeared to be an exothermic reaction that heated the coated sample relative to the reference material. This difference is believed to be caused by oxidation of the remaining carbon.

3. Aluminum Coated Sample

A ceramic sample was coated with aluminum paint, using a paintbrush. The DTA profile of this sample in FIG. 6 shows that heat-up accelerated even at relatively low temperatures. It is believed that the rapid rise in temperature is due to oxidation of the organic binder and a portion of the aluminum in the paint.

Upon removal from the oven, the temperature of the painted sample remained about 60° C. higher for more than 10 minutes compared with the uncoated sample. The longer cool down time is believed to be attributed to both lower emissivity of the remaining metallic aluminum and some oxidation (exothermic process) of the aluminum.

The color of the painted sample was gray after the test. The gray color probably indicates the presence of some metallic aluminum even though the sample was heated about 340° C. above the melting point of aluminum. Some aluminum metal was probably absorbed in pores on the cast ceramic surface.

Having described the presently preferred embodiments, it is to be understood that the invention may be otherwise embodied within the spirit and scope of the appended claims.

What is claimed is:

1. A process for starting up an electrolytic cell for producing metal by electrolytic reduction of a metal compound dissolved in a molten salt bath, said cell comprising a support structure assembly comprising a metal conductor, and a chamber containing a molten salt bath and a metal compound dissolved in said salt bath, said process comprising:

(a) providing a cermet anode having a body comprising a mixture of metal oxides and at least one metal, said body having an outer surface portion;

(b) coating at least part of said outer surface portion with a coating composition comprising carbon or aluminum or a mixture or carbon and aluminum;

(c) heating the coated cermet anode of step (b) and;

(d) connecting the heated cermet anode of step (c) with said metal conductor.

2. The process of claim 1 wherein said coating composition comprises graphite.

3. The process of claim 2 wherein said coating graphite comprises an aqueous dispersion of colloidal graphite.

4. The process of claim 1 wherein step (d) includes immersing at least part of said cermet anode in said molten salt bath, said process further comprising:

(e) passing an electric current through said salt bath between said anode and a cathode spaced from said anode, thereby to electrolyze said metal compound to produce a metal at said cathode.

5. The process of claim 4 wherein said cell produces a metal selected from the group consisting of aluminum, lead, magnesium, zinc, zirconium, titanium, and silicon.

6. The process of claim 4 wherein said cell produces aluminum, said molten salt bath comprises aluminum fluoride and sodium fluoride, and said metal compound comprises alumina.

7. The process of claim 1 wherein said coating composition of step (b) comprises an underlayer comprising aluminum adjacent said outer surface portion and an over layer comprising carbon coated over said underlayer.

8. The process of claim 1 wherein said support structure assembly includes at least one part containing a ceramic material, said part being coated with a coating composition comprising carbon.

9. The process of claim 8 wherein said ceramic material comprises alumina, calcium aluminate cement, and a frit.

10. A cell for producing aluminum by electrolytic reduction of alumina, comprising:

(a) a support structure assembly including a metal conductor;

(b) a chamber containing a molten salt bath and alumina dissolved in said bath, and;

(c) a cermet electrode having a body comprising a mixture of metal oxides and at least one metal, said body having an outer surface portion coated with a coating composition comprising carbon or aluminum or a mixture thereof.

11. The cell of claim 10 wherein said support structure assembly includes at least one part containing a high alumina ceramic material, said part being coated with a coating composition comprising carbon.

12. The cell of claim 11 wherein said coating composition on said part comprises an underlayer comprising aluminum and an overlayer comprising carbon.

13. The process of claim 11 wherein said electrode comprises an anode connected with said metal conductor.

14. A cermet anode suitable for use in an electrolytic cell, said anode comprising:

(a) a cermet body having an outer surface portion, said body comprising a ceramic phase and a metal phase, said ceramic phase comprising at least one metal oxide selected from Ni, Fe, Zn, Co, Al, Cu, Ti, V, Cr, Zr, Nb, Ta, W, Mb, Hf, and rare earth metal oxides; said metal phase comprising Cu and at least one other metal selected from Ag, Co, Ni, Fe, Al, Su, Nb, Ta, Cr, Mo, and W; and (b) a coating composition on said outer surface portion, said coating composition comprising carbon or aluminum, or a mixture of carbon and aluminum.

15. The anode of claim 14, wherein said coating composition comprises graphite.

16. The anode of claim 14, wherein said coating composition comprises an underlayer comprising aluminum and an overlayer comprising graphite.

17. The anode of claim 14, wherein said coating composition comprises a carbon layer having a thickness of about 0.1–10 mm.

18. The anode of claim 14, wherein said ceramic phase comprises iron, nickel, and zinc oxides.

19. The anode of claim 14, wherein said metal phase comprises Cu and at least one noble metal selected from the group consisting of Ag, Pd, Pt, Au, and Rh.

* * * * *